US005221122A

United States Patent [19]

Mraz

[11] Patent Number: 5,221,122

[45] Date of Patent: Jun. 22, 1993

[54] MULTIPURPOSE MINING MACHINE

[75] Inventor: Dennis Mraz, Saskatoon, Canada

[73] Assignee: Mraz Project Consulting Services, Inc., Saskatchewan, Canada

[21] Appl. No.: 720,384

[22] Filed: Jun. 25, 1991

[51] Int. Cl.[5] ..... F21C 25/06; F21C 25/52

[52] U.S. Cl. ..... 299/57; 299/73; 299/75

[58] Field of Search ..... 299/55, 57, 73, 75, 299/76, 87

[56] References Cited

U.S. PATENT DOCUMENTS

| | | | |
|---|---|---|---|
| 2,920,879 | 1/1960 | Driehaus | 299/75 X |
| 4,596,424 | 6/1986 | Wilcox, Jr. et al. | 299/75 X |
| 4,848,844 | 7/1989 | Weiss | 299/57 X |

FOREIGN PATENT DOCUMENTS

| | | | |
|---|---|---|---|
| 1185140 | 1/1965 | Fed. Rep. of Germany | 299/57 |
| 2027192 | 2/1972 | Fed. Rep. of Germany | 299/75 |
| 2124407 | 2/1984 | United Kingdom | 299/76 |

*Primary Examiner*—David J. Bagnell
*Attorney, Agent, or Firm*—Staas & Halsey

[57] ABSTRACT

A mining machine having a frame undercarriage having forward and rearward ends provided with a traction assembly for driving the frame undercarriage towards a seam face to be mined. A cutting assembly is provided which includes a plurality of rotatable outer elements each having a substantially horizontal rotation axis disposed perpendicularly to the seam face and an assembly for swinging the cutting assembly up and down with respect to the seam face about a horizontal swing axis parallel to the seam face. The swinging assembly is pivotally mounted on the forward end of the carriage to input pivotal movement of the cutting assembly about a vertical pivot axis.

14 Claims, 12 Drawing Sheets

FIRST POSITION

MOVE CUTTER LEFT

MOVE CUTTER RIGHT

MOVE CUTTER UP

MOVE CUTTER LEFT

MOVE CUTTER DOWN THEN TO FIRST POSITION

FIRST POSITION

MOVE CUTTER LEFT

MOVE CUTTER RIGHT

MOVE CUTTER UP

MOVE CUTTER LEFT

MOVE CUTTER DOWN
THEN TO FIRST POSITION

FIRST POSITION

MOVE CUTTER LEFT

MOVE CUTTER RIGHT

MOVE CUTTER UP

MOVE CUTTER LEFT

MOVE CUTTER DOWN THEN TO FIRST POSITION

PLAN SHOWING TYPICAL CUTTER HEAD SWEEP

MULTIPURPOSE MINING MACHINE

BACKGROUND OF THE INVENTION

Field of the Invention

The present invention relates generally to mining machinery and, more specifically, to a continuous mining machine having an improved mining capacity.

Description of the Related Art

Commercially available mining machines of today, used for underground mining operations, employ a variety of rotating elements which are advanced towards the face of a seam being mined.

An inherent problem with rotating mining elements is that they generate an excessive amount of fines when mining material such as coal. Also, commercially available machines do not provide a proper sumping tool and often do not provide a sufficient sumping force. Moreover, existing machines do not provide a proper sumping angle of booms used to support the rotating elements. Moreover, because there is little or no utilization of break out towards the free face, and/or stress relief in the rock, the amount of horse power provided to the rotating elements is generally insufficient.

SUMMARY OF THE INVENTION

An object of the present invention is therefore to provide a mining machine capable of mining more efficiently with a given amount of horse power by utilizing breakout towards the free face and stress relief.

Another object of the present invention is to provide a mining machine which is capable of generating a minimal amount of fines when mining materials such as coal.

Yet another object of the present invention is to provide a mining machine and method of mining capable of greater mining capacity over machines in existence today.

These and other objects of the invention are met by providing a mining machine which includes a frame undercarriage including a forward end, a rearward end, and traction means for driving the frame undercarriage towards a seam face to be mined, a cutting assembly including a plurality of rotatable outer elements each having a substantially horizontal rotation axis disposed perpendicularly to the seam face, means for swinging the cutting assembly up and down with respect to the seam face about a horizontal swing axis parallel to the seam face; and means for pivotally mounting the swinging means on the carriage to input pivotal movement of the cutting assembly about a vertical pivot axis.

These and other objects, features and advantage of the mining machine and method of use thereof will become more apparent with reference to the following detailed description and drawings.

DETAILED DESCRIPTION OF THE PREFERRED EMBODIMENTS

Figure 1:
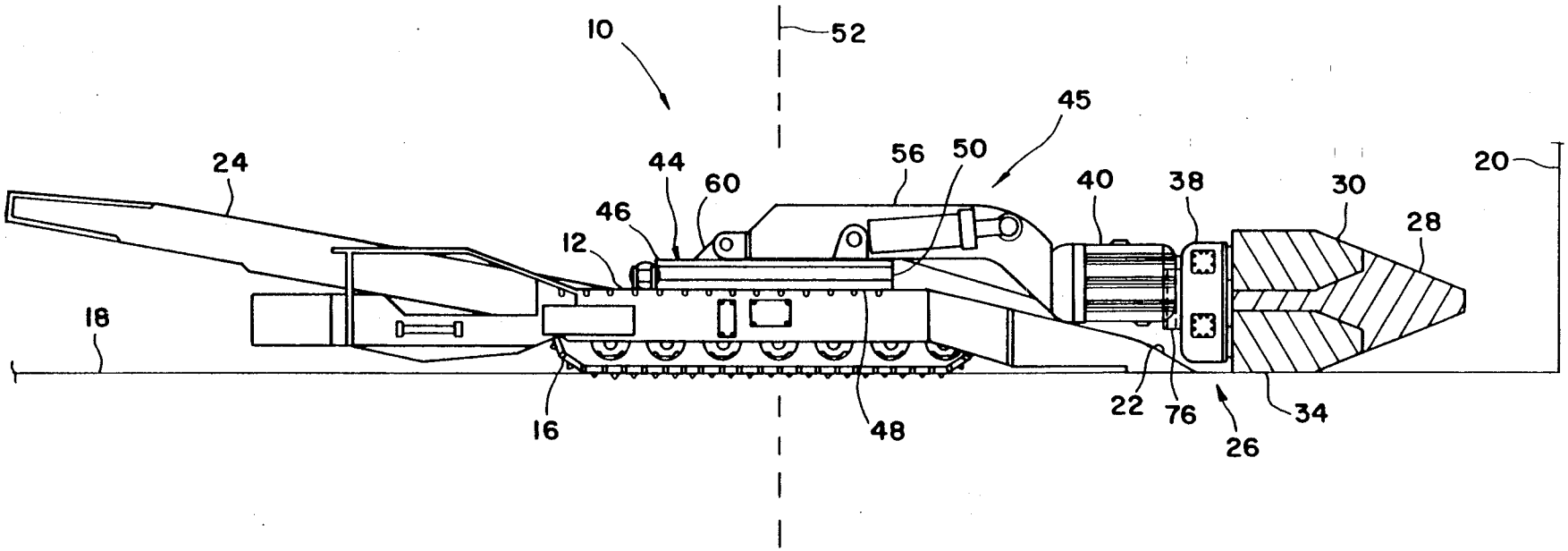
FIG. 1 is a side elevational view of a mining machine according to a first embodiment of the present invention.
Figure 2:
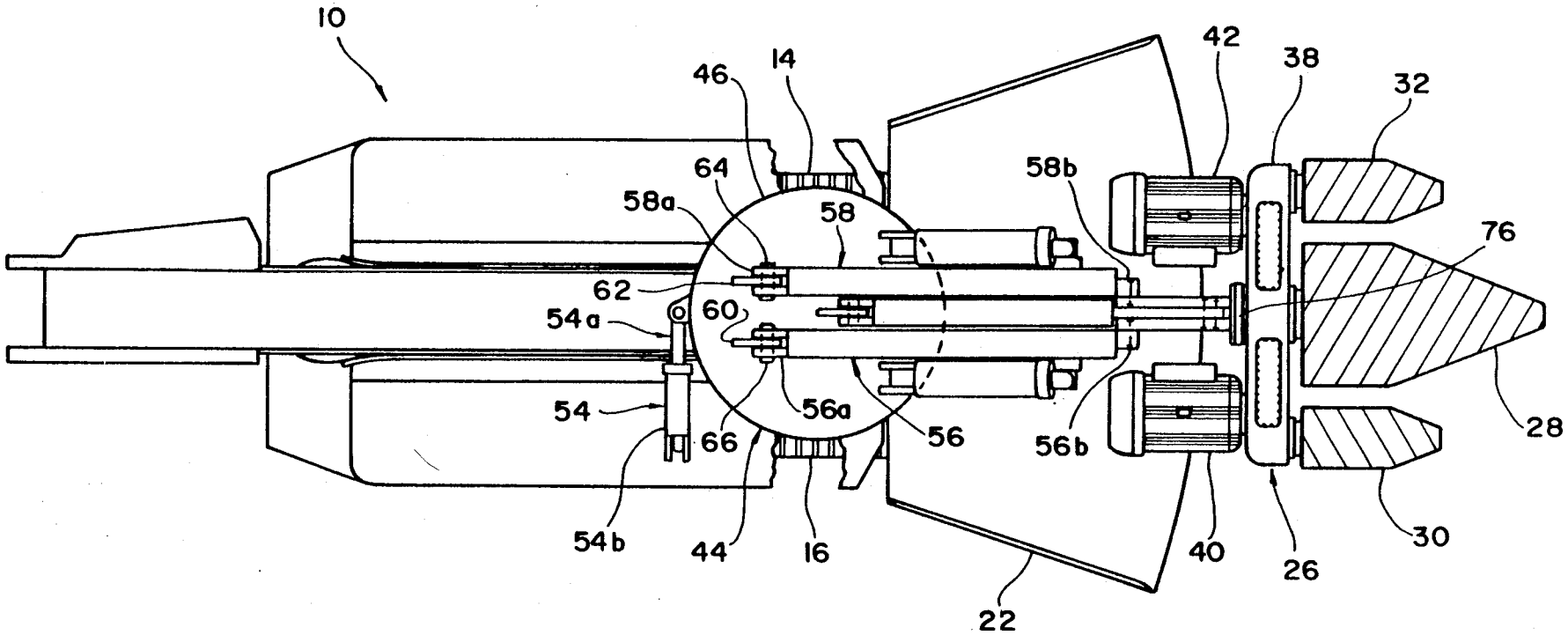
FIG. 2 is a top plan view of the mining machine of FIG. 2.
Figure 3:
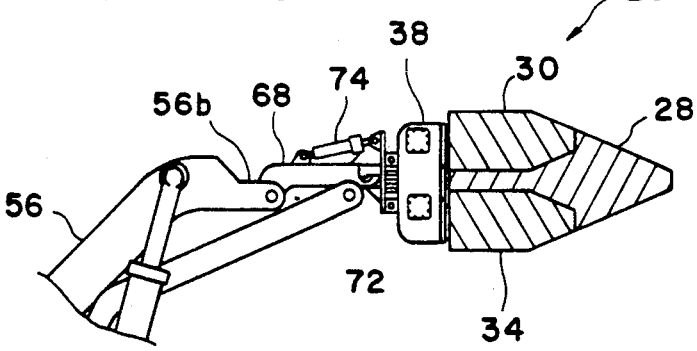
FIG. 3 is a side elevational view of a portion of the mining machine of FIG. 1 with the cutting assembly in an articulated upward position, with the electric motors removed for the sake of illustration.
Figure 4:
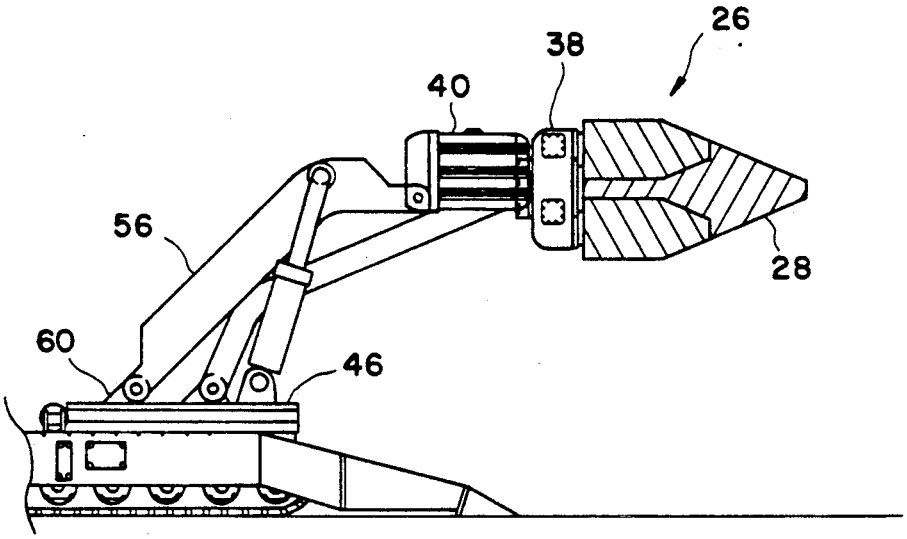
FIG. 4 is a side elevational view similar to FIG. 3 with the electric motors in place.
Figure 5:
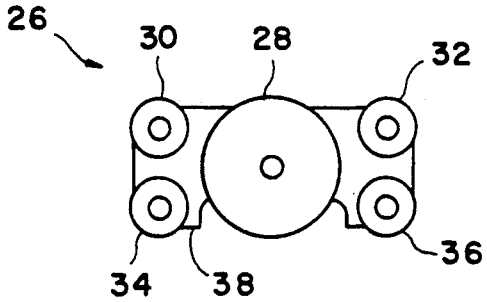
FIG. 5 is a front view showing the cutting elements of the cutting assembly of the embodiment of FIG. 1.

Referring to FIGS. 1–5, a mining machine according to the present invention is generally referred to by the numeral 10, and includes a conventional frame undercarriage 12 having traction means such as tracks 14 and 16 for driving the mining machine 10 along a mine floor towards and away from a face wall 20 to be mined.

Other drive sources may be employed, including those using wheels, so long as the machine can be propelled towards and away from the material to be excavated.

Excavated material, such as coal, is received in a head portion 22 of the mining machine 10 and conveyed rearwardly by means of a conventional conveyor portion 24, details of which have been excluded for simplicity of illustration.

A cutting assembly 26 includes a plurality of rotatable cutting elements including, in a first preferred embodiment of the invention, a large central or middle cutting element 28, a pair of smaller upper cutting elements 30 and 32, and a pair of smaller lower cutting elements 34 and 36. In FIGS. 1–5, the cutting elements 28, 30, 32, 34 and 36 are illustrated schematically with diagonal lines. Each is rotatable about a horizontal rotation axis, parallel to each other, substantially parallel to the floor 18 and perpendicular to the face 20, and being oriented longitudinally in the direction of mining. A gear box 38 interconnects the cutting elements 28, 30, 32, 34 so that a rotary driving force can be delivered from a pair of electric motors 40 and 42. In a preferred embodiment, each motor 40 and 42 has 250 kilowatts and is mounted on the back of the gear box 38. Gearing (not shown) inside the gear box 38 transfers rotary output of the electric motors 40 and 42 to all of the cutting elements 28, 30, 32, and 34. The gearing may be adapted to cause rotation of all cutting elements in the same direction of the same speed. Depending on the mining conditions and materials, the gearing could also be adapted to cause rotation of selected ones of the cutting elements to rotate in opposite directions and at different speeds.

The cutting assembly 26 is mounted on the frame undercarriage 12 at a forward end thereof through a pivotal mount 44 and a boom assembly 45. The pivotal mounting means 44 is a turntable which has a rotatable pivotal portion 46, a stationary portion 48 and a bearing portion 50 interposed between the pivotal and stationary portions. The bearing portion 50 facilitates pivotal movement of the pivotal portion 46 about a vertical pivot axis 52. A drive motor in the form of a hydraulic ram 54 imparts pivotal movement in the pivotal portion 46 by extension and retraction of an arm 54*a* under the influence of fluid pressure introduced into a cylinder 54*b*. The arm 54 is pivotally connected to the pivotal portion 46, while the cylinder 54*b* is connected to the frame undercarriage 12. Actuation of the hydraulic ram 54 is effected remotely from the machine 10 by hydraulic controls and connections (not shown) by an operator. Other drive means can be used to cause rotation of the pivotal portions, including an electric motor geared to pivotal portion 46.

The boom assembly 45 includes a pair of booms 56 and 58, each being pivotally connected to the movable portion 46 of the turntable 44 by a clevis joint which includes U-shaped proximal ends 56*a* and 58*a* of the booms 56 and 58, respectively, mounting plates 60 and 62 fixedly connected to and upstanding from the flat circular upper surface of the movable portion 46, and pins 64 and 66. The distal ends 56*b* and 58*b* of the booms 56 and 58 are pivotally connected to the proximal ends of a corresponding pair of links 68 and 70 through a pivot pin 71. The distal ends of the links 68 and 70 are pivotally connected to a mounting plate 72 through a pivot pin 72*a*, and the gear box 38 is mounted on the mounting plate 72. The horizontal orientation of the rotation axes of the cutting elements is maintained by an adjustable arm 74, which, for example, can be a hydraulic cylinder. The adjustable arm 74 can be extended and retracted to impart pivotal movement about a horizontal pivot axis disposed transverse the moving direction and parallel to the face 20. In certain situations it may be desirable to tilt the cutting assembly 26 up or down while mining, and for this purpose the arm 74 can be adjusted accordingly.

A bearing member 76 can optionally be interposed between the mounting plate 72 and the gear box 38 to facilitate pivoting of the cutting assembly 26 about an axis parallel to the mining direction and perpendicular to the face 20 in order to adjust the transverse orientation of the cutting element 26 so as to tilt to either side, if necessary. Pivotal motion can be imparted by any conventional means, such as, by providing the inner ring of the bearing with an internal gear and then driving the gear with an electric motor 78 having a drive pinion (not shown) meshing with the internal gear.

The cutting assembly 26 is caused to swing upwardly and downwardly by extension and retraction of hydraulic cylinders 80 and 82.

Cylinder 80 has a proximal end pivotally connected to the movable portion 46 of the turntable 44 by means of a pin 84 passing through parallel upstanding support plates 86 and 88. A similar mounting mechanism is provided for cylinder 82.

The arm 90 of the cylinder 80 is pivotally connected to the boom 56 by a bracket 92 which receives a transverse end 94 of the arm 90. The same type of connection is provided for the cylinder 82.

A linkage 96 is pivotally connected to the rotatable portion 46 at its proximal end thereof and pivotally connected to the pair of links 68 and 70 at its distal end thereof. The pivotal connection between the links 68 and 70 and the linkage 96 can be made by any suitable means, such as by means of a pin 98 passing through aligned mounting holes of the two links 68 and 70 and the linkage 96.

Figure 6:
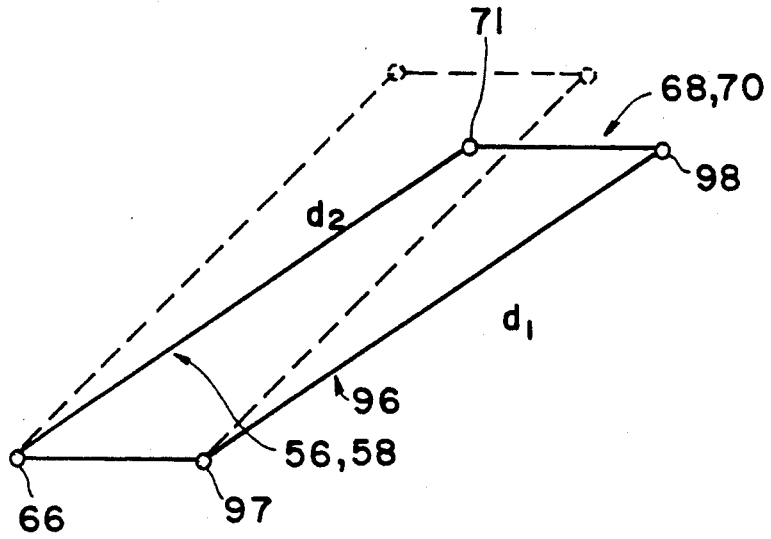
FIG. 6 is a schematic view showing a parallelogram motion of the booms used in the embodiment of FIG. 1.

Referring to FIG. 6, since the distance $d_1$ between pivot pin 97 and pivot pin 98 is fixed, and since the distance $d_2$ between pivot pin 66 and pivot pin 71 is fixed, rotation of the booms 56 and 58 and the linkage 96 will cause the cutting assembly 26 to swing up or down and maintain its horizontal disposition (or other disposition set by the arm 74), due to the parallelogram formation of the booms 56 and 58, the linkage 96, and the linkages 68 and 70. FIG. 6 shows in broken lines a 10° upward rotation of the booms 56 and 58 and the linkage 96. This results in a parallel up-shifting of the linkages 68 and 70, so that the cutting assembly 26 remains horizontal. Thus, the cutting elements are maintained in a fixed direction with respect to the longitudinal axis of the machine.

Figure 7:
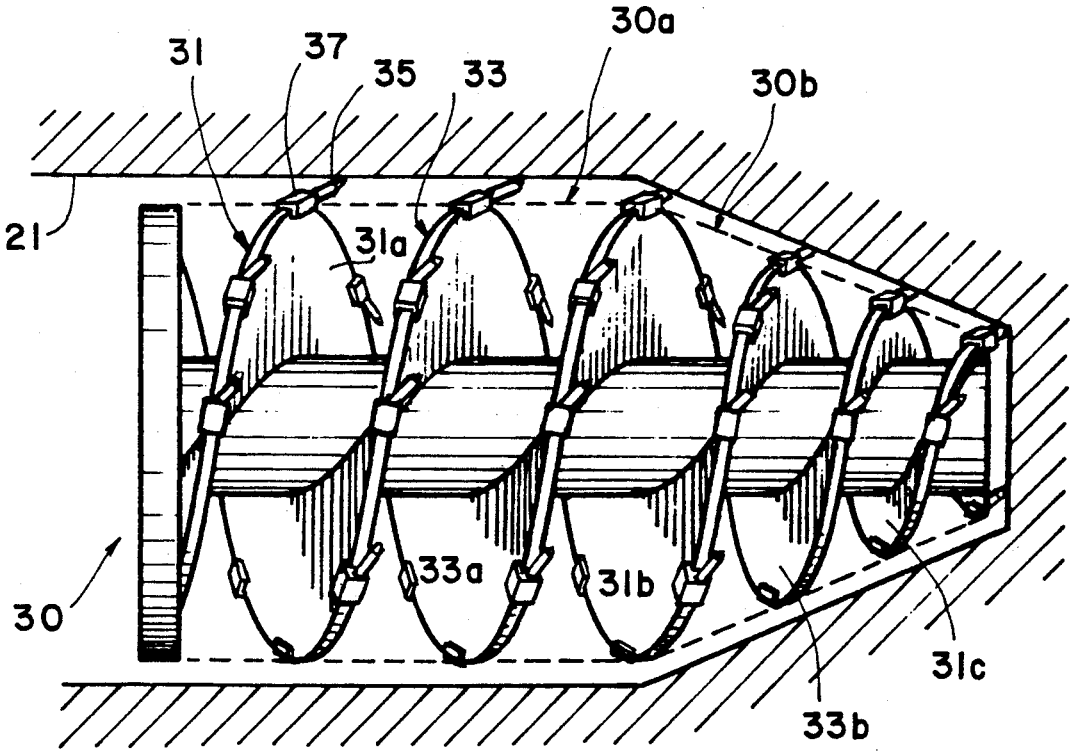
FIG. 7 is a side elevational view showing details of one of the cutting elements of the embodiment of FIG. 1 (the cutting elements being illustrated in FIGS. 1–5 schematically with parallel lines)

A preferred embodiment of a cutting element is illustrated in FIG. 7. The cutting element 30 is a double helical screw having a first helix 31 which includes a plurality of helical flights 31*a*, 31*b* and 31*c*, and a second helix 33 which includes a plurality of helical flights 33*a*, 33*b*, etc. The helical flights of the two helixes 31 and 33 alternate to define an overall profile, outlined in broken lines in FIG. 7, so as to have a cylindrical portion 30*a* and a forward, conical portion 30*b*. The spacing between the profile broken lines and the mined surface 21 is attributable to the cutting bits 35 which are mounted in bit blocks 37, with the bit blocks being welded to the individual flights at predetermined angular orientations. The number of cutting bits can be selected on the basis of the materials to be mined. In a typical circular disk cutting element, four or more cutting bits can be mounted on the circumference of each disk of the cutting element. In the present invention, the bit blocks 37 can be welded to the helical flights in a manner similar to the bit blocks used for the disks of a circular cutting element. The welding brackets of each bit block could be made at an angle to the axis of the bit so that the bit will be oriented at an angle with respect to the flight. This will provide a suitable attack angle, which is an angle at which the bit strikes the surface of the material which it is cutting. The setting of angles of attack is a commonly used practice in designing cutting tools, so that the selection of the number of cutting bits 35 and the angle of attack is easily within the purview of the skilled practitioner in the art.

The conical portion 30*b* of the cutting element 30 provides sumping geometry, while the cylindrical portion 30*a* facilitates the required contouring of the excavated opening.

In the embodiment illustrated in FIGS. 1–5, the smaller cutting elements 30, 32, 34 and 36 have the same overall shape as the larger cutting element 28 thus, the cutting element 28 would have essentially the same features as that which is illustrated in FIG. 7, except that the outer diameter of the two helixes would be increased and the overall length of the cutting element would be increased. The cylindrical portion of the cutting element 28 transitions to a conical portion at the same point where the smaller cutting elements make the same transition. Thus, from a side elevational view such as FIG. 1, the outer diameter of the upper portion of the large cutting element 28 and the upper portions of the cutting elements 30 and 32 are substantially coplanar, while the lower portion of the large cutting element 28 and the lower portions of the cutting elements 34 and 36 are also substantially coplanar. From the front view of FIG. 5, it can also be seen that the cylindrical portions of the left side cutting elements 30 and 34 are coplanar in a vertical plane, while the cylindrical portions of the right side cutting elements 32 nd 36 are also coplanar in a vertical plane.

Figure 8:
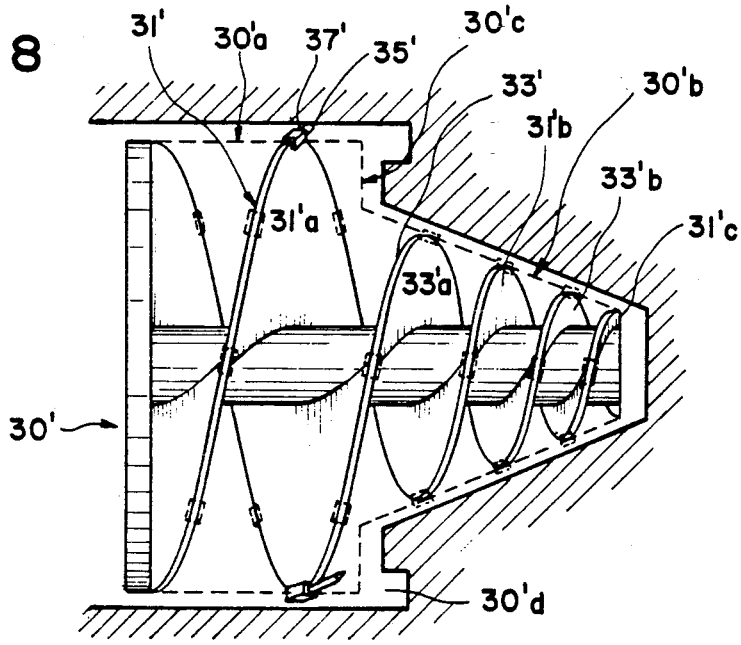
FIG. 8 is a side elevational view of another embodiment of a cutting element according to the present invention.
Figure 9A:
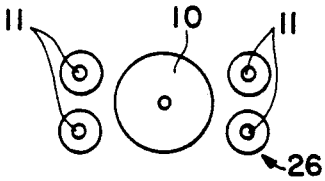
FIGS. 9(*a*) through 9(*f*) are front views showing schematically a method of mining using the cutting assembly of the embodiment of FIG. 1.
Figure 9B:
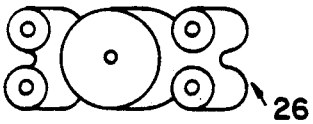
Figure 9C:
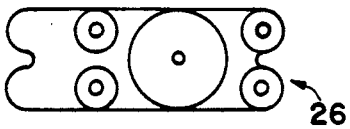
Figure 9D:
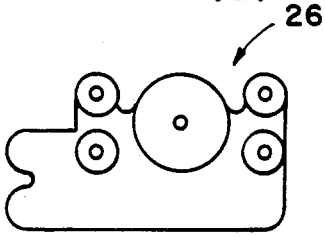
Figure 9E:
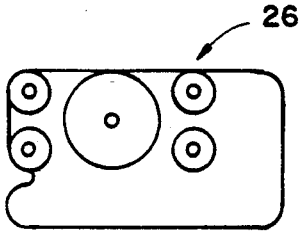
Figure 9F:
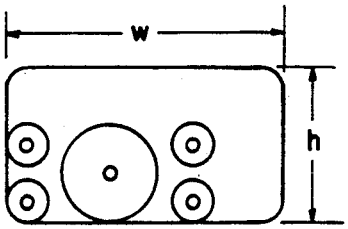

A variation of the embodiment of FIG. 7 for the cutting elements is illustrated in FIG. 8, in which the cylindrical portion 30'*a* has a relatively large outer diameter compared to the first flight 33'*a* of the cylindrical portion 30'*b*. This has the effect of creating a shoulder 30'*c* between the cylindrical portion 30'*a* and the conical portion 30'*b*. With the cutting bits 35' mounted on the flight 31'*a*, an annular space 30'*d* is formed as the cutting element 30' advances. The annular groove 30'*b* can be achieved by mounting the blocks 37' so that the cutting bits 35' are oriented at various angles from the direction of cutting. The groove 30*d'* improves break out of material against the free face, thus improving power consumption and fragmentation, so that less power is required and the excavated material is excavated in larger fragments, thus reducing the number of fines.

In general, the shape of the cutting elements illustrated in FIGS. 7 and 8 maximize the utilization of sumping force, as well as maximum utilization of break out force towards the free face. Moreover, the unique shape and assembly of the cutting elements allows the introduction of stress relief to the mining face, thus maximizing utilization of power and cutting rate. Also the unique configuration of the cutting assembly and the geometry of the boom contribute to minimizing the generation of fines.

It should be emphasized that the exact number and angle of the cutting bits is dependent upon the type of material being excavated. For example, a harder material will have a smaller angle of attack, while a softer material will have a greater angle of attack. Typically, a cutting bit may be provided at intervals of 8 to 14 inches, and the angle of attack may be about 30°. In the present case, since each flight will have an angle of about 10° to 15°, the brackets of each bit block need only to provide an additional amount of angle to make up the difference.

The bit blocks in the front of each cutting element have the same angle of attack as those on the other flights.

In the embodiment of FIG. 7, the bit blocks arranged on the flight 31'*a* will vary along the periphery of the flight so as to form the groove 30*d'*.

While the preferred embodiment of the present invention uses double helix cutting elements, a single helix cutting element could also be used with the machine described in FIGS. 1–5. A double helix is preferred because more cutting bits can be attached for the same amount of space as a single helix.

Essentially, the bit blocks and cutting bits described herein are standard in the industry and are typically used on cutting elements of mining machines.

Figure 10:
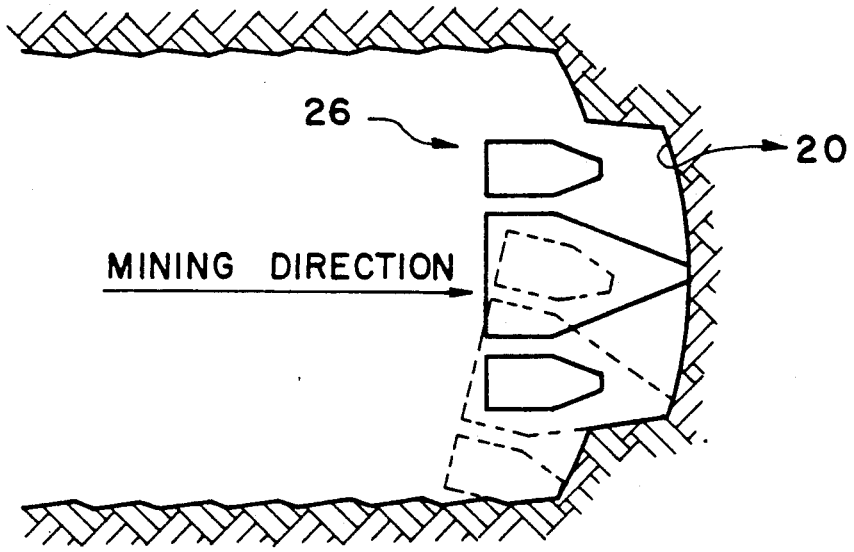
FIG. 10 is a plan view showing the tunnel contour which results from the cutting assembly of the embodiment of FIG. 1.

FIGS. 9(*a*) through 9(*f*) schematically illustrate a sequence of mining operations using the machine according to the present invention. The sumping (advance) is also accomplished in the first position, corresponding to FIG. 9(*a*), along the bottom of the opening to maximize sumping force. The cutting sequence and the configuration of cutting elements maximize break out of a large portion of material against the free face, thus minimizing consumption of power and percentage of fine material FIGS. 9(*a*) through 9(*f*) illustrate a first embodiment of the method of mining according to the present invention, in which a minimum pattern of movement is employed. After the first position, during which the cutting elements are advanced into the face, the second and third positions involve sweeping the head assembly to one side and then the other. This can be done by rotating the rotatable portion 46 of the turntable 44 through a desired range of angular motion. The side-to-side sweep of the cutter assembly is illustrated schematically in FIG. 10, which is a plan view along the mining direction. After the machine has completed its side-to-side sweep, the cutting assembly is lifted upwardly by actuating the hydraulic cylinders 80 and 82 by an amount less than the height of the cutting assembly. As shown in FIG. 9(*e*), the cutting assembly is then moved to the opposite side and then, as shown in FIG. 9(*f*), the cutting assemblies move downwardly back to the first position.

The result of the minimum pattern illustrated in FIGS. 9(*a*) through 9(*f*) is a tunnel section having a width w and a height h. As an example, the width may be about 10 feet and the height may be about 5½ feet. The contour of the tunnel from a longitudinal sectional view is illustrated in FIG. 11.

Figure 11:
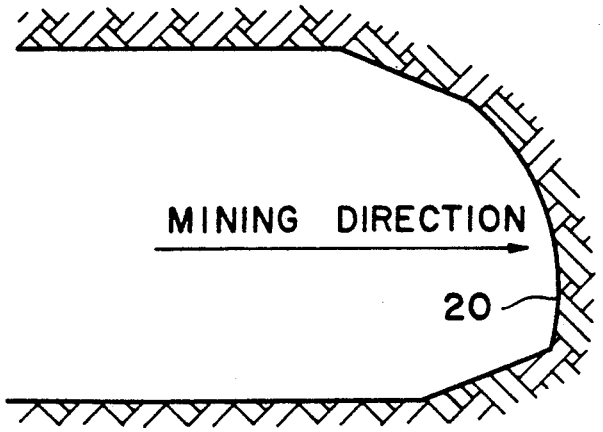
FIG. 11 is a side elevational view of the tunnel using the cutting assembly of FIG. 1.
Figure 12A:
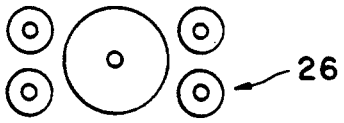
FIGS. 12(*a*) through 12(*f*) are front views schematically illustrating a variation of the method of mining illustrated in FIGS. 9(*a*) through 9(*f*), in which a wider and higher sweep of the cutting assembly is employed.
Figure 12B:
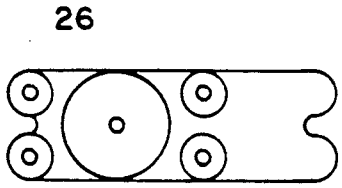
Figure 12E:
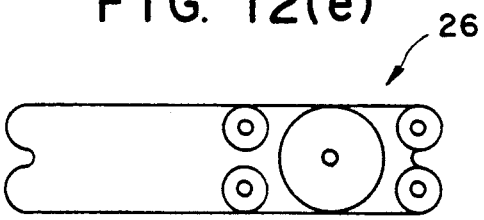
Figure 12D:
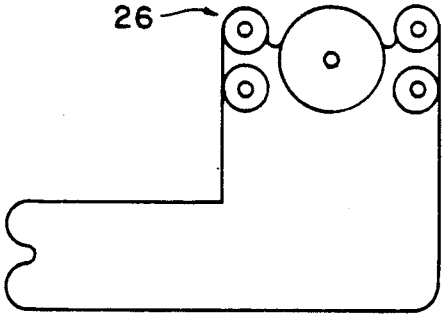
Figure 12E:
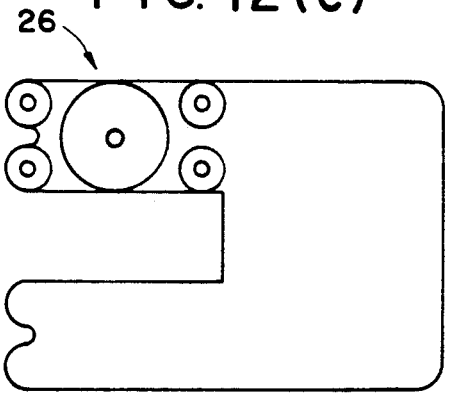
Figure 12F:
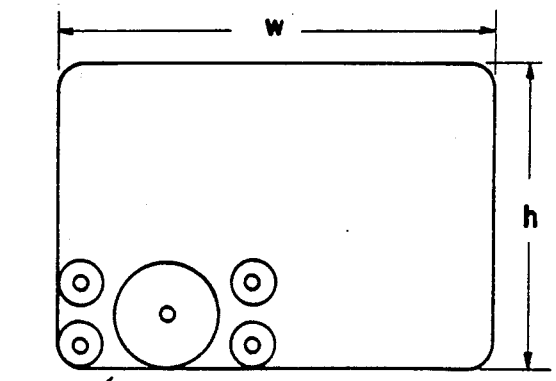

FIGS. 12(*a*) through 12(*f*) illustrate a variation of the method described with respect to FIGS. 11(*a*) through 11(*f*), in that a maximum pattern of excavation is described in sequence. In this variation, the extent of side-to-side movement of the cutting assembly 26 is about twice the width of the cutting assembly itself, whereas the amount of vertical movement is about three times the height of the cutting assembly 26. The end result shown in FIG. 12(*f*) is a tunnel having a width dimension and a height dimension. In the preferred embodiment, the width is about 15 feet and the height is about 10 feet.

Figure 13:
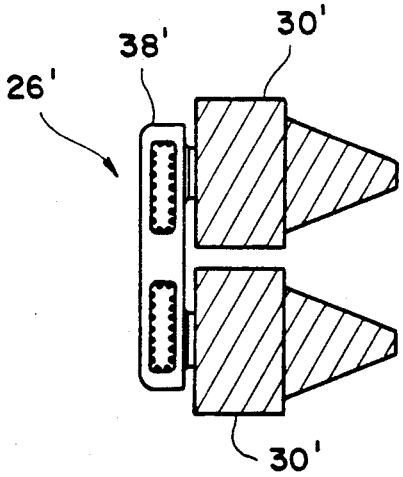
FIG. 13 is a top plan view of a cutting assembly employing the cutting elements illustrated in FIG. 8.
Figure 14:
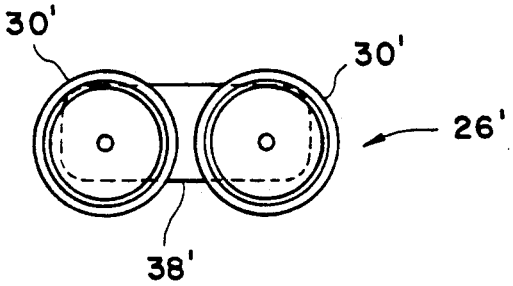
FIG. 14 is a front view showing the cutting assembly of the embodiment of FIG. 13.
Figure 15A:
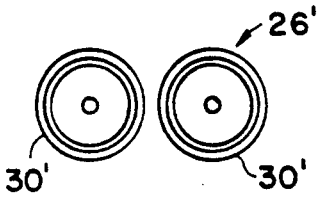
FIGS. 15(*a*) through 15(*f*) are front views showing a method of mining using the cutting assembly according to the embodiment of FIG. 13.
Figure 15B:
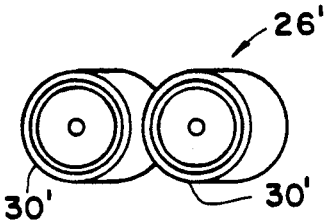
Figure 15C:
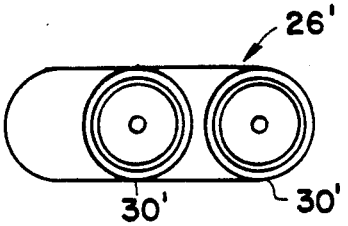
Figure 15D:
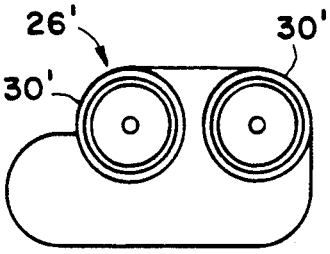
Figure 15E:
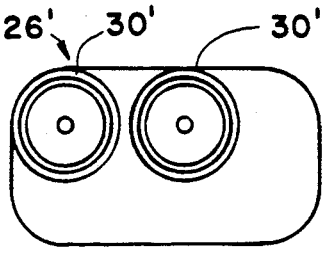
Figure 15F:
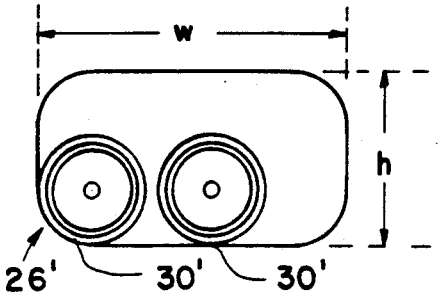

If the mining machine according to the present invention is to use the cutting element of FIG. 8, the cutting assembly will have a different arrangement. As shown in FIGS. 13 and 14, the gear box 38' drives two cutting elements 30'.

Referring to FIGS. 15(*a*) through 15(*f*), the two-cutting element cutting assembly 26' of the embodiment of FIGS. 13 and 14, employing the cutting elements 30' illustrated in FIG. 8, is moved in a pattern which is the same as that which is illustrated in FIGS. 9(*a*) through 9(*f*), in that from the starting position, the cutting elements 30' are moved to the left and then to the right, followed by upward movement, left-hand movement, and then downward movement to the first position. The height h' of the tunnel and the width w' corresponds substantially to that which is illustrated in FIG. 9(*f*). Basically, the pattern illustrated in FIGS. 15(*a*) through 15(*f*) corresponds to the minimum pattern. A maximum pattern corresponding to that which is illustrated in FIGS. 12(*a*) through 12(*f*) can be employed, whereby the range of movement from left to right is about twice the width of the cutting assembly, and the range of upward movement is about three times the height of the cutting assembly. The overall dimensions of a tunnel mined according to the maximum pattern as described above would be similar to that which is illustrated in FIGS. 12(*a*) through 12(*f*), or about 15 feet in width and 10 feet in height.

Figure 16:
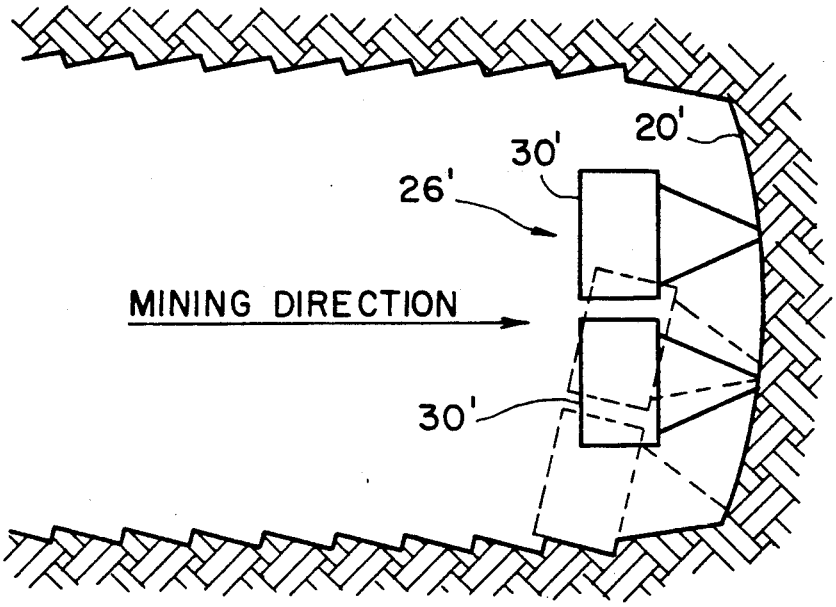
FIG. 16 is a top plan view showing a tunnel contour using the cutting assembly of the embodiment of FIG. 13.
Figure 17:
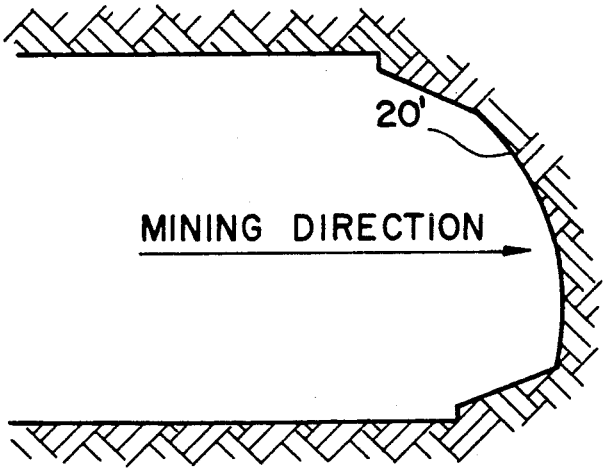
FIG. 17 is a side elevational view showing the tunnel contour using the cutting assembly of the embodiment of FIG. 13.

FIGS. 16 and 17 respectively show plan views and side elevational views of the mining contour of a tunnel using the embodiment of FIGS. 13 and 14, used according to the method illustrated in FIGS. 15(*a*) through 15(*f*).

Figure 18:
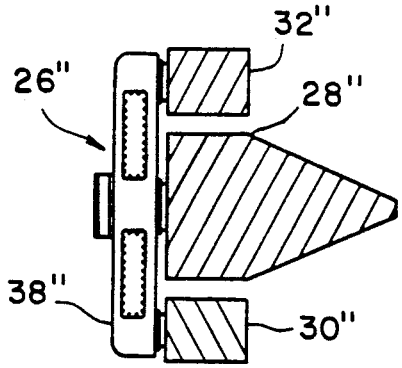
FIG. 18 is a top plan view of another embodiment of a cutting assembly.
Figure 19:
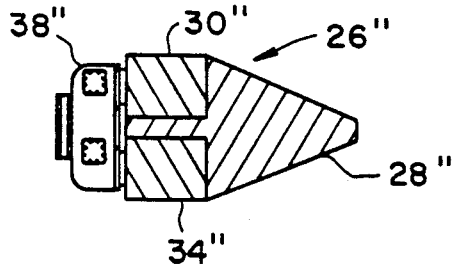
FIG. 19 is a side elevational view of the embodiment of FIG. 18.
Figure 20:
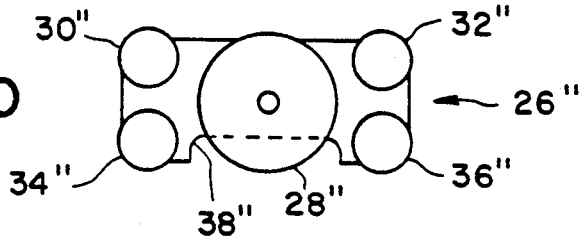
FIG. 20 is a front view of the embodiment of the cutting assembly of FIG. 18.

Another embodiment of the present invention can be seen in FIGS. 18, 19 and 20, in which the cutting assembly 26'' includes a large central cutting element 28'' having a cylindrical portion and a conically shaped portion and two pairs of smaller diameter cutting elements 30'', 32'', 34'' and 36'', all of which are interconnected through a gear box 38'' as in the previous embodiments. The large central cutting element 28'' has a configuration the same as that of the cutting element 28 of FIG. 3. The smaller cutting elements 30'', 32'', 34'' and 36'' have the same double helix construction as the cylindrical portion of the cutting elements 30, 32, 34, and 36 of the embodiment of FIGS. 1 through 5, but do not include a conically shaped portion.

Figure 21:
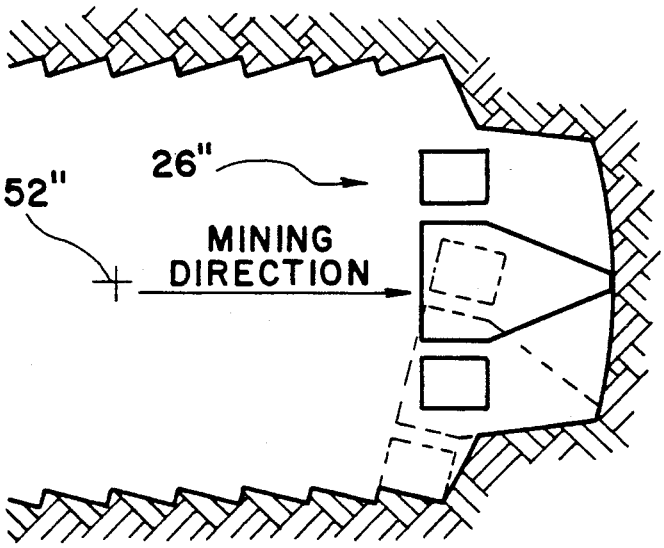
FIG. 21 is a top plan view showing the contour of a tunnel mined according to the method described with respect to FIGS. 9(*a*) through 9(*f*) and 12(*a*) through 12(*f*), and using the cutting assembly of FIG. 18.
Figure 22:
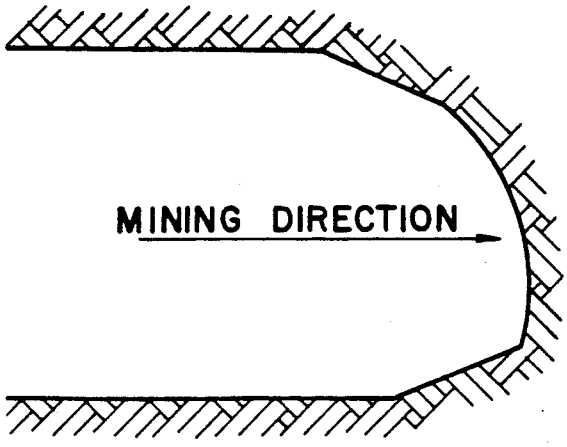
FIG. 22 is a side elevational view showing the tunnel contour using the embodiment of FIG. 18.

The mining method used according to the embodiment of FIGS. 18–20 is the same as that which is described with respect to FIGS. 9(*a*) through 9(*f*) and 12(*a*) through 12(*f*). FIG. 21 shows a typical cutting assembly 26'' sweep in a plan view, and FIG. 22 shows the contour of the tunnel floor and ceiling as well as the face resulting from the cutting assembly used according to the embodiments of FIGS. 18–20. In FIG. 21, the pivot axis 52'' of the cutting assembly 26'' is illustrated as well.

Figure 23:
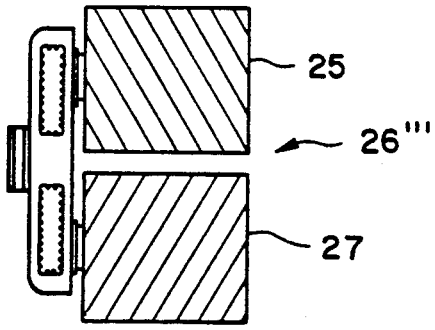
FIG. 23 is a top plan view of a cutting assembly of another embodiment of the present invention, employing two drum-shaped double helix cutting elements of equal size.
Figure 24:
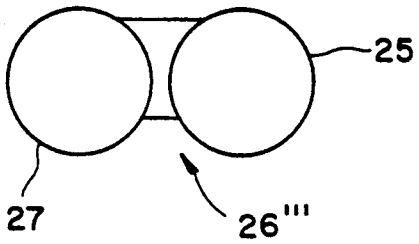
FIG. 24 is a front view of the embodiment of FIG. 23.
Figure 25:
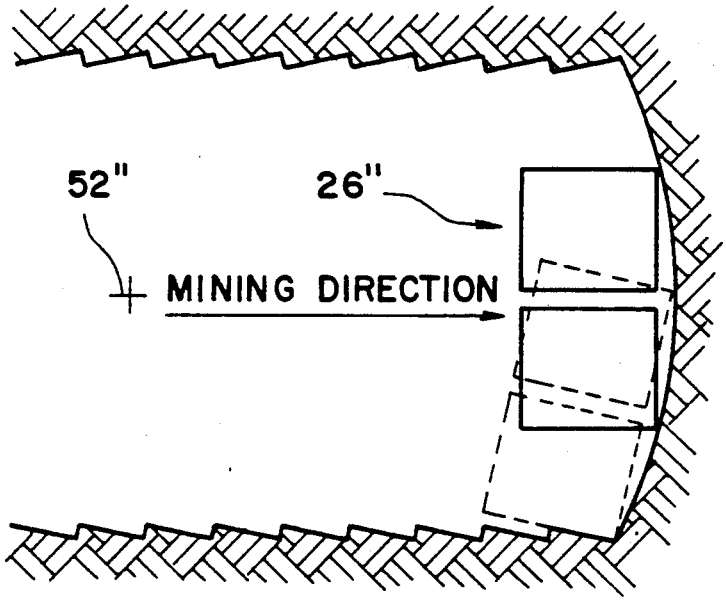
FIG. 25 is a top plan view showing the tunnel contour resulting from the cutting assembly of FIG. 23.
Figure 26:
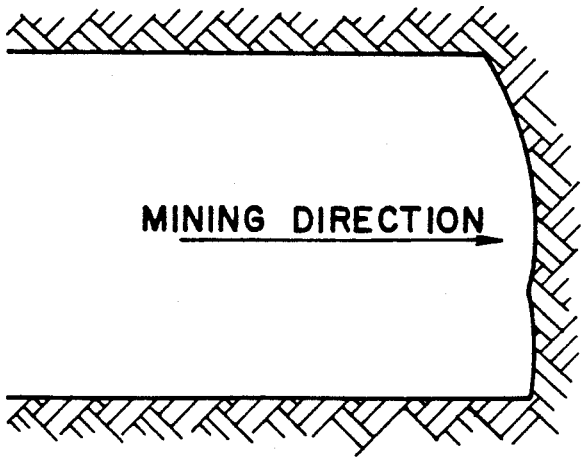
FIG. 26 is a side elevational view showing the tunnel contour using the embodiment of FIG. 23.

FIGS. 23 and 24 illustrate another embodiment of the present invention in which the cutting assembly 26''' includes a pair of large cutting elements 25 and 27, each having a drum shape corresponding to the cylindrical portion of the large central cutting element 28 of the embodiment of FIGS. 1–5. However, the axial length of each cutting element has been enlarged compared to the axial length of the cylindrical portion of the cutting element 28 of the embodiment of FIGS. 1–5. The method of mining using the cutting assembly 26''' of the embodiment of FIGS. 23 and 24 will result in a mining pattern the same as that which is illustrated in FIGS. 15(*a*) through 15(*f*). Also, the resulting contour of the tunnel can be seen in FIGS. 25 and 26 which show respectively a plan view of a cutting assembly 26''' sweep and a side elevation view showing floor, ceiling and phase walls of the tunnel. FIG. 25 also shows the pivot axis 52''' of the cutting assembly 26'''.

Numerous modifications and adaptations of the present invention will be apparent to those so skilled in the art and thus, it is intended by the following claims to cover all such modifications and adaptations which fall within the true spirit and scope of the invention.

What is claimed is:

1. A mining machine comprising:

a frame undercarriage including a forward end, a rearward end, and traction means for driving the frame undercarriage towards a seam face to be mined;

a cutting assembly including a plurality of rotatable cutting elements each having a substantially horizontal rotation axis disposed perpendicularly to the seam face;

means for swinging the cutting assembly up and down with respect to the seam face about a horizontal swing axis parallel to the seam face, including a boom assembly including first and second parallel boom arms, each having a proximal end pivotally connected to the pivotally mounting means and a distal end pivotally connected to the cutting assembly, a first link having a proximal end pivotally connected to the distal ends of the first and second boom arms and a distal end pivotally connected to the cutting assembly, and a second link having a proximal end pivotally connected to the pivotally mounting means and a distal end pivotally connected to the distal end of the first link; and means for pivotally mounting the swinging means on the forward end of the carriage to input pivotal movement of the cutting assembly about a vertical pivot axis.

2. A mining machine according to claim 1, wherein the first and second boom arms and the first and second links define a parallelogram having two parallel, substantially horizontal sides through a range of swinging motion of the cutting machine.

3. A mining machine according to claim 1, further comprising first and second extendable actuators, coupled respectively to the first and second boom arms, for selectively imparting up and down swinging motion to the cutting assembly through the first and second boom arms.

4. A mining machine according to claim 3, wherein each of the first and second extendable actuators comprises a fluid pressurized cylinder having an arm driven by fluid pressure, the cylinder having a proximal end pivotally connected to the pivotally mounting means and the arm having a distal end pivotally connected to each corresponding boom arm near the distal end thereof.

5. A mining machine according to claim 1, further comprising an adjustable arm coupled between the second link and the cutting assembly, said adjustable arm having an adjustable length which in a normal position maintains the cutting assembly in a substantially horizontal orientation.

6. A mining machine according to claim 1, wherein the pivotally mounting means comprises a turntable having a stationary portion fixedly connected to the frame undercarriage at the forward end thereof and a rotary portion journalled in the stationary portion, the swinging means being mounted on the rotary portion of the turntable.

7. A mining machine according to claim 6, further comprising drive means coupled between the rotary portion of the turntable and the frame undercarriage, for pivoting the rotary portion of the turntable.

8. A mining machine according to claim 1, wherein the cutting assembly comprises a gear box interconnecting the plurality of cutting elements and drive motor means for rotating the cutting elements through the gear box.

9. A mining machine according to claim 1, further comprising a counterweight carried by the rearward end of the frame undercarriage to offset a tilting movement operated by the cutter assembly.

10. A mining machine according to claim 1, wherein each of the plurality of cutting elements comprises a double helix screw having cutting bits fixed on a perimeter of the double helix screw.

11. A mining machine according to claim 10, wherein each of the plurality of cutting elements has a forward conical portion and a rearward cylindrical portion.

12. A mining machine comprising:

a frame undercarriage including a forward end, a rearward end, and traction means for driving the frame undercarriage towards a seam face to be mined;

a cutting assembly including a plurality of rotatable cutting elements each having a substantially horizontal rotation axis disposed perpendicularly to the seam face, a gear box interconnecting the plurality of cutting elements and drive motor means for rotating the cutting elements through the gear box;

means for swinging the cutting assembly up and down with respect to the seam face about a horizontal swing axis parallel to the seam face, said gear box being rotatably mounted on the swinging means for rotation about an axis parallel to the rotation axes of the cutting elements; and means for pivotally mounting the swinging means on the forward end of the carriage to input pivotal movement of the cutting assembly about a vertical pivot axis.

13. A mining machine according to claim 12, wherein the plurality of cutting elements includes a central cutting element, a pair of upper cutting elements disposed on opposite sides of the central cutting element and a pair of lower cutting elements disposed on opposite sides of the central cutting element, wherein in vertical section the upper most contour of the pair of upper cutting elements follows an upper most contour of the central cutting element.

14. A mining machine according to claim 13, wherein in vertical section a lower most contour of the pair of lower cutting elements follows a lower most contour of the central cutting element.

* * * * *